US006592685B2

(12) United States Patent
Goecmen

(10) Patent No.: US 6,592,685 B2
(45) Date of Patent: Jul. 15, 2003

(54) TRANSFORMATION CONTROLLED NITRIDE PRECIPITATION HARDENING HEAT TREATABLE STEEL

(75) Inventor: Alkan Goecmen, Baden-Daettwil (CH)

(73) Assignee: Alstom (Switzerland) Ltd, Baden (CH)

( * ) Notice: Subject to any disclaimer, the term of this patent is extended or adjusted under 35 U.S.C. 154(b) by 16 days.

(21) Appl. No.: 10/002,117

(22) Filed: Dec. 5, 2001

(65) Prior Publication Data

US 2002/0139449 A1 Oct. 3, 2002

(30) Foreign Application Priority Data

Dec. 18, 2000 (DE) ..... 100 63 117

(51) Int. Cl.[7] ..... C22C 38/42; C22C 38/44; C22C 38/46; C22C 38/50; C22C 38/52

(52) U.S. Cl. ..... 148/327; 148/326; 148/663; 420/38; 420/39; 420/54; 420/70

(58) Field of Search ..... 148/326, 327, 148/663; 420/36–39, 52–54, 56–59, 69, 70

(56) References Cited

U.S. PATENT DOCUMENTS 5,650,024 A * 7/1997 Hasegawa et al. ..... 148/326
6,030,469 A * 2/2000 Ernst et al. ..... 148/325
6,464,804 B2 * 10/2002 Goecmen et al. ..... 148/325

FOREIGN PATENT DOCUMENTS

| | | |
|---|---|---|
| DE | 891 399 | 9/1953 |
| DE | 197 12 020 A1 | 9/1998 |
| DE | 197 40 908 C1 | 8/1999 |
| EP | 0 866 145 A2 | 9/1998 |

* cited by examiner

*Primary Examiner*—Deborah Yee
(74) *Attorney, Agent, or Firm*—Burns, Doane, Swecker & Mathis, L.L.P.

(57) ABSTRACT

The invention relates to a transformation controlled nitride precipitation hardening heat-treatable steel with the following composition (data in wt. %): 15–18 Cr, max. 0.5 Mn, 4–10 Ni, max. 15 Co, max. 4 W, max. 4 Mo, 0.5–1 V, at least one of Nb, Ta, Hf and Zr totaling between 0.001–0.1, 0.001–0.05 Ti, max. 0.5 Si, max. 0.05 C, 0.13–0.25 N, max. 4 Cu, rest iron and usual impurities, under the condition that the weight ratio of vanadium to nitrogen V/N is in the range between 3.5 and 4.2. The invention also relates to a heat treatment process for this steel. Very good strength, ductility and also corrosion resistance can be attained.

21 Claims, 5 Drawing Sheets

TRANSFORMATION CONTROLLED NITRIDE PRECIPITATION HARDENING HEAT TREATABLE STEEL

FIELD OF THE INVENTION

The invention relates to a transformation controlled nitride precipitation hardening heat-treatable steel with 15–18 wt. % chromium. The steel has a combination of strength, toughness and resistance to stress crack corrosion, and can therefore be used to advantage in the chemical industry, transportation technology, power station technology, building technology, and in plastics processing.

BACKGROUND OF THE INVENTION

Transformation controlled martensitically hardenable steels are known state of the art, for example, the alloy 17–5 ph with 15.4 wt. % Cr, 4.4 wt. % Ni, 0.4 wt. % Mn, 0.25 wt. % Si, 3.3 wt. % Cu, 0.3 wt. % Nb and 0.04 wt. % C, or the alloy 14–5 ph with 14 wt. % Cr, 5 wt. % Ni, 0.4 wt. % Mn, 0.25 wt. % Si, 1.6 wt. % Cu, 0.25 wt. % Nb, 1.5 [wt. %] Mo and 0.05 wt. % C. The nickel and chromium contents are balanced out here so that no, or very little, delta-ferrite arises during the austenizing.

Transformation controlled steels are strengthened by martensitic transformation and by precipitation hardening. Martensite arises by means of a quenching treatment following the austenizing, while the precipitation hardening is effected by a heat treatment of the quenched martensite. Transformation controlled steels are therefore usually first austenized, quenched, and following after this, heat treated at medium temperatures. The respective structure formation is influenced by the action of the alloying elements and the heat treatment parameters on the transformation temperatures $M_S$, $M_f$ and $A_{cl}$. $M_s$ is the temperature at which the transformation from austenite to martensite begins during quenching; $M_f$ is the temperature at which the transformation of the austenite to martensite during quenching is ended, and $A_{cl}$ is the temperature at which austenite formation begins during heating up.

The $M_S$ temperature of the martensitically hardenable steels is sufficiently high because a large part of the austenite present during austenizing can be converted into martensite by normal cooling to room temperature. The $M_S$ temperature is furthermore affected by the grain size and the dissolved substitution elements, which facilitate precipitation hardening. The coarser the grain and the higher the proportion of dissolved alloying elements, the lower is the $M_S$ temperature.

The residual austenite after a complete austenizing followed by cooling treatment is transformable. If substitution elements are precipitated during a tempering treatment, the $M_S$ temperature of the residual austenite can increase again such that this is converted into martensite again in the following annealing treatment. To be distinguished from residual austenite is the tempering austenite which remains behind after a partial austenizing, accordingly annealing in the ferrite-austenite two-phase region and subsequent cooling treatment.

For an optimized combination of precipitation hardenability and grain size limitation, two kinds of alloying elements are added in conventional transformation controlled martensitic steels:

Nb and C for precipitation hardenability, though primarily for grain size limitation;

Cu exclusively for hardening through precipitation hardening.

Massive grain growth brings about insufficient stability of the niobium carbides at temperatures above 1,050° C., so that the austenizing at these temperatures is limited. Maximum precipitation hardenability is attained at temperatures around 450–500° C. However, a tempering treatment at these temperatures results in very low ductilities and in particular a very low resistance against stress crack corrosion.

Tempering austenite, in contrast to residual austenite, has a very favorable effect on ductility (toughness) and stress crack corrosion resistance. It has the more favorable effects on these properties, the finer the preceding (former) austenite grain was. Ductility is well increased by means of a double austenizing, the second austenizing at lower austenizing temperatures serving, not only for grain refining (normalizing) but also for a limited precipitation of niobium carbides which, together with the grain refining, further increases the $M_S$ temperature. Tempering austenite is formed at temperatures between 550 and 650° C., a maximum content of tempering austenite being attained at temperatures around 600° C.

An increased proportion of tempering austenite has a favorable effect on strength and stress crack corrosion resistance. On the other hand, especially at elevated carbon contents, the formation of tempering austenite during a tempering treatment in the region between 550 and 650° C. is associated with a sensitization of the austenite. By this is understood a worsening of the corrosion resistance (particularly to intercrystalline corrosion) due to grain boundary precipitation of chromium-rich phases.

The attainable combination of strength and stress crack corrosion resistance is limited by the fact that the structure-forming forms required for these two properties are formed at distinctly different tempering temperatures, i.e.:

| | |
|---|---|
| Precipitation hardening: | 450–550° C. |
| Tempering austenite: | 550–650° C. |

SUMMARY OF THE INVENTION

The invention seeks to avoid these disadvantages. It has as its object to provide a martensitic hardenable steel which has an improved combination of strength, ductility and corrosion resistance, and also a heat treatment process for such an alloy.

A transformation controlled nitride precipitation hardening heat treatable steel has the following composition (data in wt. %): 15–18 Cr, max. 0.5 Mn, 4–10 Ni, max. 15 Co, max. 4 W, max. 4 Mo, 0.5–1 V, at least one from Nb, Ta, Hf and Zr totaling between 0.001 and 0.1, 0.001–0.05 Ti, max. 0.5 Si, max. 0.05 C, 0.13–0.25 N, max 4 Cu, rest iron and usual impurities, under the condition that the weight ratio of vanadium to nitrogen, V/N, is in the region between 3.5 and 4.2.

By the choice of the alloying elements, a high corrosion resistance can be attained, besides a high strength and ductility. It is appropriate if the steel has 1–10 wt. % Co; 0.5–3, preferably 0.5–1.5, wt. % Cu; 15–17, preferably 15.5–16.5, wt. % Cr; 0.5–0.7 wt. % V, 0.16–0.2 wt. % N; 0.01–0.07 wt. % Nb, and a total of Mo and W in the range 1–6, preferably 1–4.

Preferred Mo contents lie in the range of 1.5–3 wt. %; of Mn, in the range of 0.02–0.4 wt. %; and of Si, in the range of 0.02–0.25 wt. %. The C content is preferably 0.02 wt. %.

It is furthermore advantageous if the alloys according to the invention are heat treated as follows: Solution annealing at 1,050–1,250° C./0.2–10 h, preferably 1180° C./2 h,; cooling in air to RT; intermediate annealing at 640° C.–780° C./0.2–10 h, preferably 2 h; tempering treatment at 570–630° C./0.2–5 h, preferably 600° C./1 h. Within the scope of this heat treatment, an increased volume proportion of tempering austenite is produced, and the special nitrides are not only used for grain size limitation at high austenizing temperatures and for precipitation hardening, but also make possible a finer distribution of austenite fractions within the martensitic base structure.

BRIEF DESCRIPTION OF THE DRAWINGS

Preferred embodiments of the invention are disclosed in the following description and illustrated in the accompanying drawings, in which.

Figure 1:
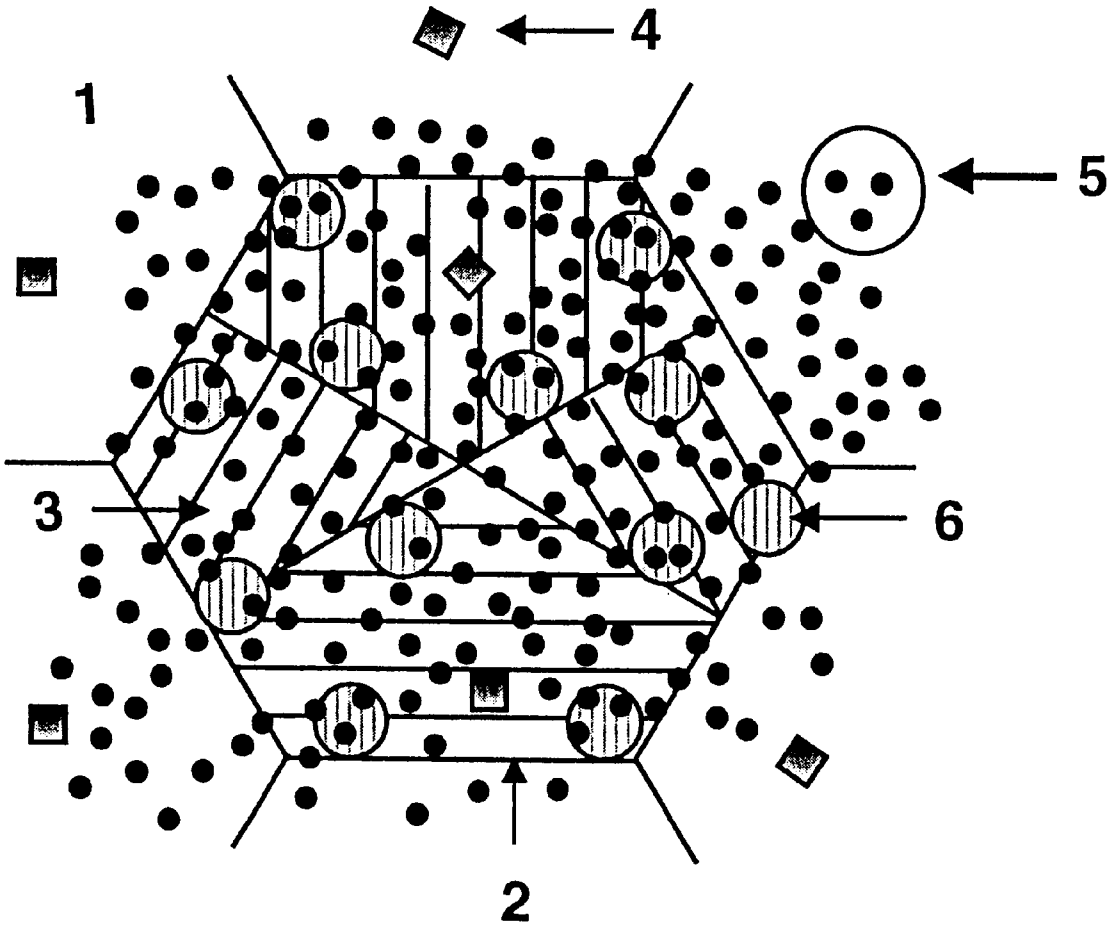
FIG. 1 shows, schematically illustrated, an image of the structure of the alloy according to the invention.

Only the elements which are important for the understanding of the invention are shown.

DETAILED DESCRIPTION OF THE INVENTION

A transformation controlled nitride precipitation hardening heat treatable steel has the following composition (data in wt. %): 15–18 Cr, max. 0.5 Mn, 4–10 Ni, max. 15 Co, max. 4 W, max. 4 Mo, 0.5–1 V, at least one from Nb, Ta, Hf and Zr totaling between 0.001 and 0.1, 0.001–0.05 Ti, max. 0.5 Si, max. 0.05 C, 0.13–0.25 N, max 4 Cu, rest iron and usual impurities, under the condition that the weight ratio of vanadium to nitrogen, V/N, is in the region between 3.5 and 4.2.

By the choice of the alloying elements, a high corrosion resistance can be attained, besides a high strength and ductility. It is appropriate if the steel has 1–10 wt. % Co; 0.5–3, preferably 0.5–1.5, wt. % Cu; 15–17, preferably 15.5–16.5, wt. % Cr; 0.5–0.7 wt. % V, 0.16–0.2 wt. % N; 0.01–0.07 wt. % Nb, and a total of Mo and W in the range 1–6, preferably 1–4.

Preferred Mo contents lie in the range of 1.5–3 wt. %; of Mn, in the range of 0.02–0.4 wt. %; and of Si, in the range of 0.02–0.25 wt. %. The C content is preferably 0.02 wt. %.

In detail, the alloying elements have the following effects:

Chromium

Chromium is the most important alloy element for corrosion resistance. An increasing alloy proportion meanwhile increases the residual austenite proportion. Above 17% chromium, a martensitic full hardening is no longer possible. Good alloys have a chromium content expected to be between 15 and 17%. A particularly preferred range is 15.5–16.5%.

Nickel

Nickel is an austenite stabilizing element, and is used for suppressing delta-ferrite. Within the scope of the desired alloy design, at least 4% is required for this purpose. Increasing contents meanwhile reduce the $M_S$ temperature and increase the residual austenite proportion. Above 10% nickel, a martensitic full hardening in the presence of about 15% chromium is no longer possible.

Cobalt

Cobalt is an austenite-stabilizing element, and is likewise used for suppressing delta-ferrite. Unlike nickel, however, it reduces the $M_S$ temperature far less, so that martensitic hardenable alloys with cobalt content of up to 15% can be designed. Furthermore, cobalt reinforces precipitation harden-ability by molybdenum and tungsten. A preferred range is 1–7% cobalt, taking account of the high price of cobalt and the improvements which can be attained.

Molybdenum and Tungsten

Both elements contribute to strength by mixed crystal hardening. At elevated contents, they can furthermore considerably increase the strength by precipitation hardening. Both elements likewise meanwhile reduce the $M_S$ temperature and thus increase the residual austenite proportion. The preferred proportion of molybdenum and tungsten is therefore limited to 6% in all. It is further known that molybdenum improves corrosion resistance. Molybdenum is therefore preferred over tungsten. Having regard to a preferred combination of strength and corrosion resistance, the preferred range of Mo is 1–4%. A particularly preferred range is 1.5–3%.

Vanadium and Nitrogen

The addition of both elements leads to the formation of vanadium nitrides, which can be used both for grain size limitation and for precipitation hardening. The effect is greatest when these two elements are stoichiometrically alloyed to each other. A preferred ratio of V to N is 3.5–4.2. The preferred nitrogen content is in the range between 0.16 and 0.20%, and that of vanadium in the range between 0.5 and 0.7%.

Titanium

The addition of titanium leads to the formation of titanium nitrides. This phase can considerably contribute to grain refining and grain size limitation. The addition of more than 0.05% titanium leads to the formation of coarse titanium nitrides which are of little effectiveness, so that the proportion of titanium is to be limited to 0.05%.

Manganese

Manganese is an austenite-stabilizing element. Its effect in the suppression of delta-ferrite is however not so strong as that of nickel and of cobalt. On the other hand, it strongly reduces the $M_S$ temperature. This combination of properties is very unfavorable within the scope of the desired alloy design. The weight proportion of 0.5% manganese is therefore not to be exceeded.

Silicon

Silicon is to be used exclusively for deoxidation purposes. However, too high a content reduces toughness. Therefore the weight proportion of silicon is to be limited to 0.5%.

Carbon

Carbon is an element which is effective in suppressing delta-ferrite. On the other hand, this element leads to a further lowering of the $M_S$ temperature, and must therefore be limited to 0.05%. Besides this, carbon promotes the precipitation of chromium carbides at the grain boundaries during the tempering treatment, and thus worsens corrosion resistance (sensitization). Carbon should therefore preferably be limited to 0.03%.

The invention is described in more detail hereinafter, using embodiment examples and FIGS. 1–5.

FIG. 1 shows schematically the structure of an alloy according to the invention. It is martensitic and is subdivided into former austenite grains 1, which are decomposed into martensite crystals (blocks) 2, which in their turn are decomposed into a set of column-shaped sub-grains (laths) 3.

Vanadium nitrides 5 or vanadium/niobium nitrides 4 are embedded in this structure. These nitrides have either survived a high austenizing temperature (primary nitrides 4) or were formed in subsequent heat treatment stages (secondary nitrides 5). Secondary nitrides 5 can be formed during a re-austenizing at lower temperatures, and also during a tempering treatment of the martensite 2.

Austenite grains 6 are additionally embedded in this structure. This austenite 6 is to be understood as tempering austenite, since it is produced in a final tempering treatment and remains behind after cooling to room temperature.

The primary nitrides 4 are somewhat coarser than the secondary nitrides 5, but both kinds of nitride 4 and 5 are very uniformly distributed. An optimum hardening effect is attained by this uniformity. This takes place both by grain refining and also by particle hardening. Resistance against massive grain coarsening up to temperatures of 1,180° C. can be attained by the low coarsening tendency of the primary vanadium/niobium mixed nitrides 4. A not unimportant solubility gap for the vanadium nitride 4 exists between austenizing temperatures of 730 and 1,180° C. Nitrides which are dissolved in an austenizing at 1,180° C. can to a large extent be reprecipitated in a re-austenizing between 730 and 850° C. These nitrides remain sufficiently fine so that they contribute by means of particle hardening to the overall realized strength. However, it is preferred that a grain refining is associated with the re-austenizing, effectively supported by the presence of the primary nitrides 4 and also by the newly forming vanadium nitrides 5. Grain refining and new precipitation of nitrides 5 together make possible a very effective rise in the $M_S$ temperature.

Tempering austenite 6 develops at temperatures between 550 and 650° C. Above a temperature of 600° C.,vanadium nitrides 5 can easily be precipitated in the martensitic matrix 2 and provide an important contribution to strength. It is of importance that the growth of the tempering austenite 6 during its formation is strongly impaired by the nitrides 4, 5 present. Thus if the austenite 6 is successfully produced in a high nucleation density, it can be uniformly and finely distributed within the martensite 2 and under the effect of the nitrides 4, 5 present. An increased nucleation density can be achieved by a fine martensite 2.

The formation of chromium nitride is suppressed, since the nitrogen is already bound in the prior heat treatment phase. Chromium therefore remains in solution, and the susceptibility to sensitization is small.

Precipitation hardening can be further increased by copper. A further precipitation hardening is possible by the alloying of molybdenum and/or tungsten in combination with nickel and cobalt. The addition of molybdenum can then further improve corrosion resistance.

The structure of the alloys according to the invention has a series of advantages over the alloys known in the prior art. For example:

Massive grain coarsening sets in at higher temperatures. Higher austenizing temperatures can thereby be used, so that a greater volume proportion of special nitrides can also be brought into solution.

The grain refining in re-austenizing is improved by the presence and new formation of special nitrides. Grain refining and new precipitation of nitrides make possible an effective rise in the $M_S$ temperature. The newly formed nitrides provide an additional strength contribution by particle hardening.

Tempering austenite is limited in its growth as a consequence of the closely present nitrides. It can thereby be embedded more uniformly and finely in the martensitic basic structure. No strength is lost due to the uniformity and fineness, and the yield strength/tensile strength ratio remains high.

The vanadium nitrides are sufficiently stable against coarsening under the tempering conditions under which tempering austenite is formed (550–650° C.), so that the formation of the tempering austenite is not linked to an over-ageing of the precipitation phases.

The alloy according to the invention is well stabilized against the precipitation of chromium carbide or chromium nitride. Thus the corrosion resistance can be kept high.

It is to be emphasized that in the alloys according to the invention, both the precipitation hardening and also the formation of tempering austenite can be implemented in the same temperature range of 550–650° C. FIGS. 2–5 show strength and hardness values of the alloys AP39, AP40 and AP41 according to the invention, in comparison with the reference alloys 14–5 ph and 17–4 ph. The chemical composition of the alloys concerned is to be gathered from the following Table 1 (n.s.=not specified).

TABLE 1

| | Chemical Composition | | | | |
|---|---|---|---|---|---|
| | 17-4ph | 14-5ph | AP39 | AP40 | AP41 |
| Fe | Rest | Rest | Rest | Rest | Rest |
| Cr | 15.4 | 14 | 15.2 | 15.1 | 15.0 |
| Ni | 4.4 | 5 | 4.3 | 4.4 | 4.4 |
| Mn | 0.4 | 0.4 | 0.05 | 0.04 | 0.05 |
| Si | 0.25 | 0.25 | 0.18 | 0.14 | 0.16 |
| Co | n.b. | n.b. | 4.7 | 4.6 | 2.6 |
| Cu | 3.3 | 1.6 | n.s. | 3.4 | 3.4 |
| V | n.s. | n.s. | 0.6 | 0.6 | 0.64 |
| Ti | n.s. | n.s. | 0.003 | 0.004 | 0.004 |
| Nb | 0.3 | 0.25 | 0.04 | 0.04 | 0.04 |
| Mo | n.s. | 1.5 | 1 | 0.9 | 1 |
| N | n.s. | n.s. | 0.16 | 0.16 | 0.16 |
| C | 0.04 | 0.05 | 0.02 | 0.02 | 0.02 |

The alloys according to the invention are produced in the following manner:

1. Melting in vacuum induction furnace at ambient pressure.
2. Homogenizing at 1,200° C./10 h.
3. Forging of plates at temperatures between 1,180° C. and 900° C.

Figure 2:
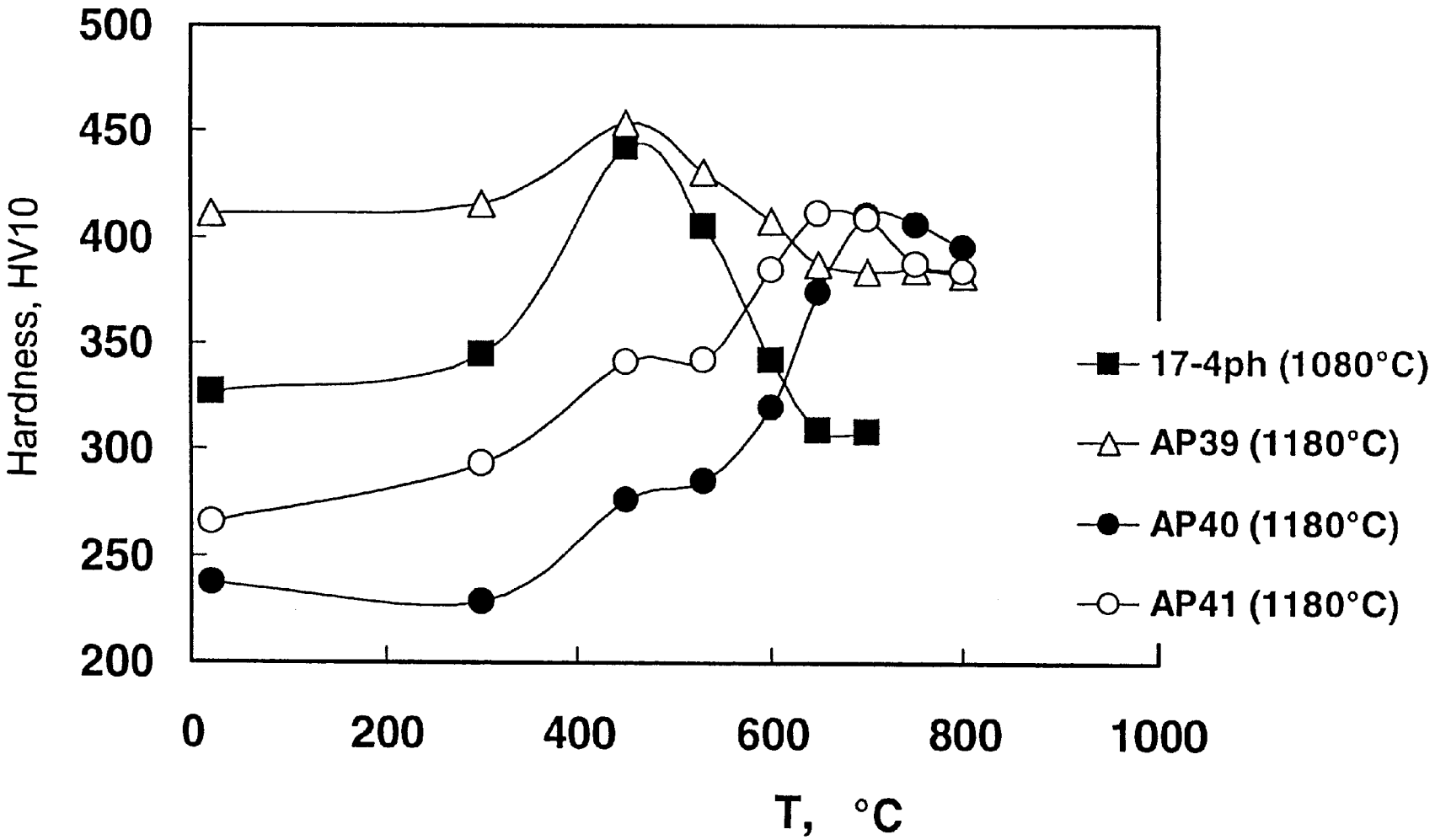
FIG. 2 is a diagram showing the dependence of the hardness HV 10 on the tempering temperature for three alloys according to the invention (AP39, AP40, AP41) and for the comparison alloy 17–4 ph.

FIG. 2 shows the tempering curves of the alloys AP39, AP40 and AP41 according to the invention, which were solution annealed at 1,180° C./2 h in comparison with the commercial alloy of type 17–4 ph which was solution annealed at 1,050° C./2 h. All the test samples with a heat treatment cross section of 30 mm were cooled in air. The tempering time was 2 hours in each case. Vickers hardness HV 10 of the samples investigated was plotted in dependence on the tempering temperature T. It can be clearly seen that at tempering temperatures above 600° C., substantially higher hardness values were attained with the alloys according to the invention than with the comparison alloy.

For the determination of the strength values of the alloys AP39, AP40, AP41 according to the invention and also of the comparison alloy of type 14–5ph, the heat treatments described in Table 2 were carried out:

TABLE 2

Heat Treatment Parameters

| | 14-5ph | | | AP39-41 | | |
|---|---|---|---|---|---|---|
| | LZA450 | LZA550 | LZA620 | WB1 | WB2 | WB3 |
| Solution annealing L | 1,050° C. | 1,050° C. | 1,050° C. | 1,180° C./ 2 h | 1,180° C./ 2 h | 1,180° C./ 2 h |
| Intermediate Annealing Z | 850° C./ 2 h | 750° C./ 2 h | 750° C./ 2 h | 640° C./ 2 h | 730° C./ 2 h | 780° C./ 2 h |
| Tempering A | 450° C./ 5 h | 550° C./ 2 h | 620° C./ 2 h | 600° C./ 1 h | 600° C./ 1 h | 600° C./ 1 h |

Figure 3:
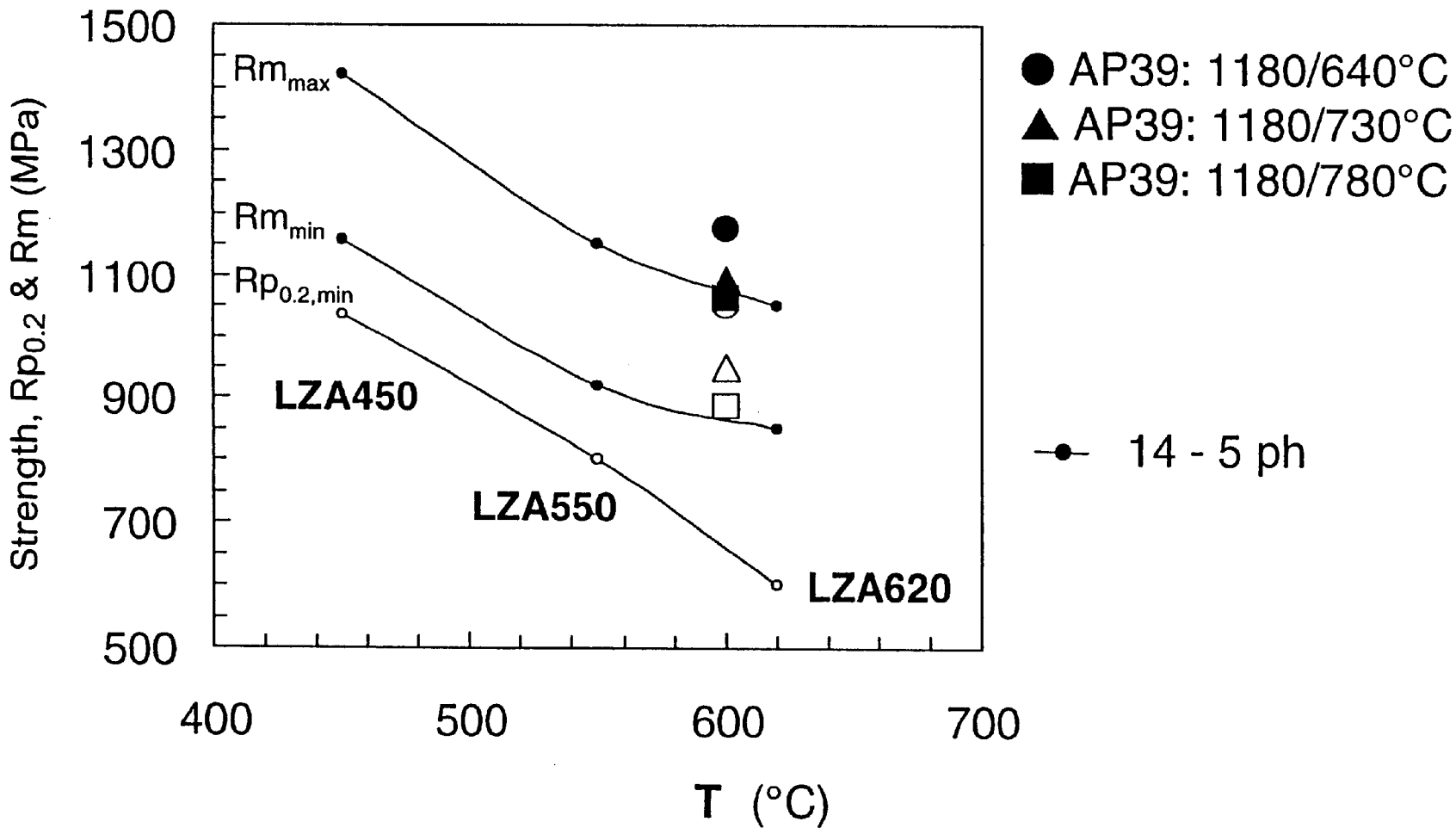
FIG. 3 is a diagram showing the dependence of the strength of the alloy AP39 on the intermediate annealing temperature in comparison with the strength of the comparison alloy 14–5 ph at different tempering temperatures.
Figure 4:
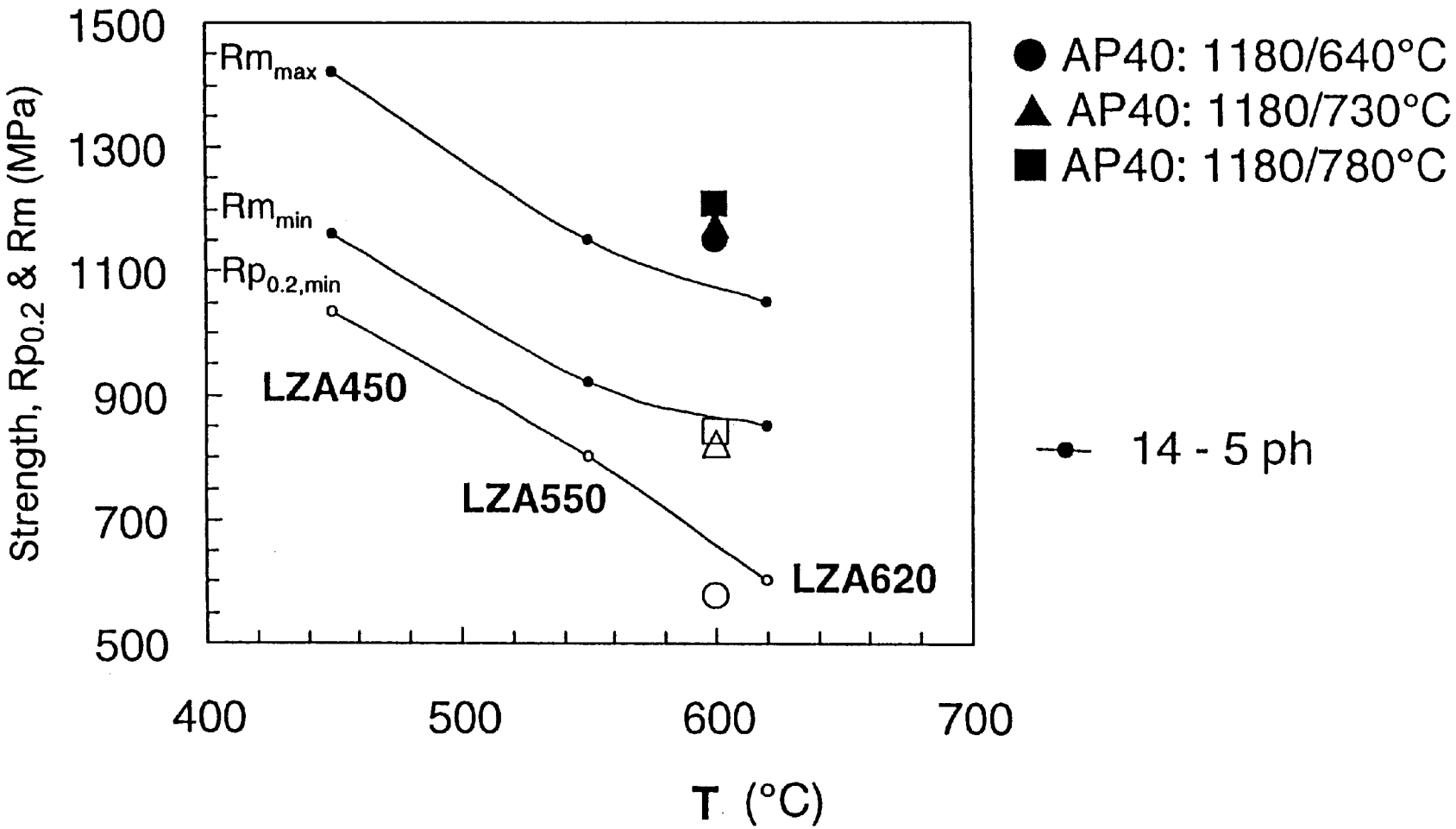
FIG. 4 shows the dependence of the strength of the alloy AP-40 according to the invention on the intermediate annealing temperature, in comparison with the strength of the comparison alloy 14–5 ph at different tempering temperatures.
Figure 5:
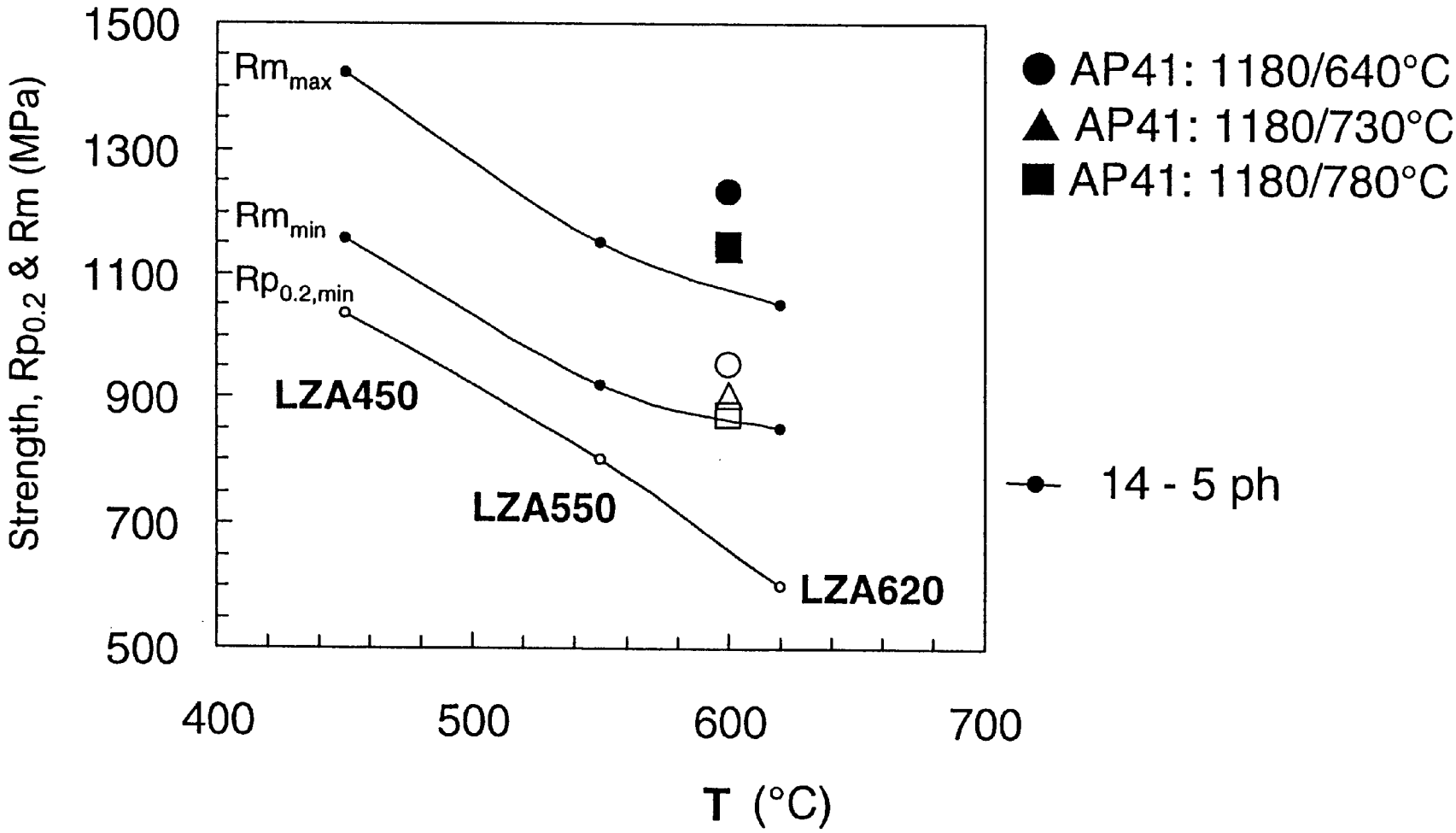
FIG. 5 shows the dependence of the strength of the alloy AP41 according to the invention on the intermediate annealing temperature in comparison with the strength of the comparison alloy 14–5 ph at different tempering temperatures.

FIGS. 3–5 show strength values of the alloys AP39 (FIG. 3), AP40

(FIG. 4), and AP41 (FIG. 5) according to the invention after a solution annealing at 1,180° C., an intermediate annealing at 640° C., 730° C. or 780° C., and also a final tempering treatment at 600° C. The strengths (yield strength $R_{p0.2}$ and tensile strength $R_m$) are compared with typical values for the alloy 14–5 ph known from the prior art in the heat treatment state LZA450, LZA550 and LZA4620. The open symbols here relate to the yield strength, and the closed symbols to the tensile strength. All three alloys according to the invention have tensile strength values after the final tempering treatment at 600° C. which are near, or clearly above, the upper limits of variation of the steel of type 14–5 ph. The alloys AP39 and AP41 have yield strengths after the final tempering treatment at 600° C. which are close to, or clearly above, the upper limit of variation of the steel of type 14–5 ph. It is thus shown that with the alloys according to the invention after a tempering treatment at 600° C., strength values can still be attained, for which tempering temperatures of about 550° C. have to be used for the conventional alloys. This means that even in that temperature range in which the tempering austenite is preferably formed, still higher strength values can be attained. The invention is of course not limited to the described embodiment examples.

What is claimed is:

1. Transformation controlled nitride precipitation hardening heat treatable steel, the steel having a composition comprising (in wt. %): 15–18 Cr, max. 0.5 Mn, 4–10 Ni, max. 15 Co, max. 4 W, max. 4 Mo, 0.5–1 V, at least one of Nb, Ta, Hf and Zr totaling between 0.001–0.1, 0.001–0.05 Ti, max. 0.5 Si, max. 0.05 C., 0.13–0.25 N, max. 4 Cu, rest iron and usual impurities, wherein a weight ratio of vanadium to nitrogen V/N is in the range between 3.5 and 4.2.

2. Transformation controlled nitride precipitation heat-treatable steel according to claim 1, wherein the composition has 1–10 wt. % Co.

3. Transformation controlled nitride precipitation heat-treatable steel according to claim 1, wherein the composition has 0.5–3 wt. % Cu.

4. Transformation controlled nitride precipitation heat-treatable steel according to claim 3, wherein the composition has 0.5–1.5 wt. % Cu.

5. Transformation controlled nitride precipitation heat-treatable steel according to claim 1, wherein the composition has 15–17 wt. % Cr.

6. Transformation controlled nitride precipitation heat-treatable steel according to claim 5, wherein the composition has 15.5–16.5 wt. % Cr.

7. Transformation controlled nitride precipitation heat-treatable steel according to claim 1, wherein the composition has a maximum of 0.03 wt. % C.

8. Transformation controlled nitride precipitation heat-treatable steel according to claim 7, wherein the composition has a maximum of 0.02 wt. % C.

9. Transformation controlled nitride precipitation heat-treatable steel according to claim 1, wherein the composition has 0.5–0.7 wt. % V and 0.16–0.20 wt. % N.

10. Transformation controlled nitride precipitation heat-treatable steel according to claim 1, wherein the composition has 0.01–0.07 wt. % Nb.

11. Transformation controlled nitride precipitation heat-treatable steel according to claim 1, wherein the composition has a total of Mo and W in the range between 1 and 6 wt. %.

12. Transformation controlled nitride precipitation heat-treatable steel according to claim 11, wherein the composition has 1–4 wt. % Mo.

13. Transformation controlled nitride precipitation heat-treatable steel according to claim 12, wherein the composition has 1.5–3 wt. % Mo.

14. Transformation controlled nitride precipitation heat-treatable steel according to claim 1, wherein the composition has 0.02–0.4 wt. % Mn.

15. Transformation controlled nitride precipitation heat-treatable steel according to claim 1, wherein the composition has 0.02–0.25 wt. % Si.

16. Process for the heat treatment of a heat-treatable steel according to claim 1, the process comprising the following steps:

solution annealing at 1,050–1,250° C./0.2–10 h, cooling in air to RT;

intermediate annealing at 640–780° C./0.2–10 h; and tempering treatment at 570–630° C./0.2–5 h.

17. Process for the heat treatment of a heat-treatable steel according to claim 16, the process comprising the following steps:

solution annealing at 1,180° C./2 h, cooling in air to RT;

intermediate annealing at 640° C.–780° C./2 h; and tempering treatment at 600° C./1 h.

18. A process for the heat treatment of a heat-treatable steel, the process comprising the steps of:

solution annealing the heat-treatable steel at 1,180° C. for 2 to 10 hours;

cooling the heat-treatable steel in air to RT;

intermediate annealing the heat-treatable steel at 640° C.–780° C. for 2 to 10 hours; and tempering the heat-treatable steel at 600° C. for 1 h, wherein the heat-treatable steel has a composition comprising (in wt. %): 15–18 Cr, max. 0.5 Mn, 4–10 Ni, max. 15 Co, max. 4 W, max. 4 Mo, 0.5–1 V, at least one of Nb, Ta, Hf and Zr totaling between 0.001–0.1, 0.001–0.05 Ti, max. 0.5 Si, max. 0.05 C, 0.13–0.25 N, max. 4 Cu, and the balance iron and usual impurities, and wherein a weight ratio of vanadium to nitrogen V/N is in the range between 3.5 and 4.2.

19. The process of claim 18, wherein tempering results in a Vickers hardness (HV 10) of at least 350.

20. The process of claim 18, wherein tempering results in a yield strength of at least 850 MPa.

21. The process of claim 18, wherein tempering results in a tensile strength of at least 1100 MPa.

* * * * *